US006542577B1

(12) United States Patent
Kaczmarek et al.

(10) Patent No.: US 6,542,577 B1
(45) Date of Patent: Apr. 1, 2003

(54) HERMETICALLY SEALED STATOR CORD FOR X-RAY TUBE APPLICATIONS

(75) Inventors: Andrew R. Kaczmarek, Compton, IL (US); Mark S. Maska, Palatine, IL (US)

(73) Assignee: Koninklijke Philips Electronics, N.V., Eindhoven (NL)

( * ) Notice: Subject to any disclaimer, the term of this patent is extended or adjusted under 35 U.S.C. 154(b) by 0 days.

(21) Appl. No.: 09/641,301

(22) Filed: Aug. 18, 2000

(51) Int. Cl.[7] ..... H01I 37/00
(52) U.S. Cl. ..... 378/130; 378/194; 378/200
(58) Field of Search ..... 378/130, 131, 378/194, 193, 199, 200, 141; 439/551, 462, 227, 546, 548, 562, 566

(56) References Cited

U.S. PATENT DOCUMENTS 3,719,918 A * 3/1973 Kerr ..... 439/319
RE28,168 E 9/1974 Cope et al.
3,963,930 A 6/1976 Fiocca et al.
4,107,535 A * 8/1978 Kotabe et al. ..... 250/406
4,778,949 A * 10/1988 Esterle et al. ..... 174/151
5,008,916 A * 4/1991 Le Guen ..... 378/118
5,259,790 A * 11/1993 Hayward ..... 439/578
5,490,198 A 2/1996 Gerling
5,875,227 A 2/1999 Bhatt
5,923,723 A * 7/1999 Herbst ..... 378/101

* cited by examiner

*Primary Examiner*—Robert H. Kim
*Assistant Examiner*—Hoon K. Song
(74) *Attorney, Agent, or Firm*—Fay, Sharpe, Fagan, Minnich & McKee, LLP

(57) ABSTRACT

A connection device (70) provides electrical connection between a stator motor (50) of an x-ray tube and a stator cord (56). The connection device is connected with the x-ray tube housing (30) by threading a threaded portion (80) into a corresponding threaded aperture (82) in the housing to create a leak-tight seal. The threaded portion is rigidly connected with a connecting portion (100), such as a bayonet socket, which receives a corresponding fitting (102) of the stator cord. An electrical conduction path (125), hermetically sealed in the connecting device, provides electrical connection between the socket and the interior of the housing. The connection device allows the stator cord to be quickly connected or disconnected from the housing yet provides a seal which resists leakage of cooling oil from the housing.

10 Claims, 6 Drawing Sheets

HERMETICALLY SEALED STATOR CORD FOR X-RAY TUBE APPLICATIONS

BACKGROUND OF THE INVENTION

The present invention relates to the vacuum tube arts. It finds particular application in connection with a device for linking a stator cord to the housing of an x-ray tube in CT scanners, and will be described with particular reference thereto. It should be appreciated, however, that the invention is also applicable to the formation of sealed couplings for other liquid-containing devices and x-ray tubes for other applications.

X-ray sources, such as those utilized in the field of medicine for the imaging of subjects, typically include a rotating anode contained within an evacuated envelope. The anode is connected with a rotor having a rotatable shaft. A stator circumferentially surrounds the rotatable shaft. During operation of the x-ray tube, a beam of electrons emitted by a cathode is accelerated towards the anode by a high voltage differential. The electrons strike a target area of the anode where they are converted to x-rays.

Only a small fraction of the energy of the electron beam is converted to x-rays, however. The majority of the energy is converted to heat, which heats the anode white hot. The x-ray tube envelope is commonly mounted within a housing filled with a cooling oil for carrying away some of the heat. Wires for the stator, filament heater, the voltage differential, and other electrical functions of the x-ray tube pass through the oil-filled housing and out through a port or ports in the housing wall. The wires from the stator (stator cord) typically continue for some distance to the controller for the x-ray tube, in some instances, as much as forty feet away.

To prevent leakage of the oil from the housing around the stator cord, the port in the housing is preferably sealed oil tight. In some applications, the wires are potted in epoxy or clamped by a plastic fitting. One such fitting has a flange with an O-ring on its underside and is held to the housing with screws. Another such fitting is formed from metal and has a peripheral flange and O-ring on the inside of the housing and a nut threadably received on the outside of the housing to hold the fitting in the wiring port with the O-ring firmly held against the adjacent housing.

Such fittings tend to be subject to some leakage. The oil in the housing is at relatively low pressure, and thus does not help to seal the O-ring against the housing. Additionally, the hard wiring created provides a wiring harness up to forty feet long, which is awkward and inconvenient. Further, if the x-ray tube is to be replaced, significant hand labor is employed to rewire the tube and reseal the ports through the housing.

The present invention provides a new and improved socket for connecting a wiring harness to an x-ray tube, and method of use, which overcomes the above-referenced problems and others.

SUMMARY OF THE INVENTION

In accordance with one aspect of the present invention, an x-ray apparatus is provided. The x-ray apparatus includes an evacuated envelope and a stator, both within a housing. The stator generates a magnetic field for driving an anode within the envelope. A stator cord, exterior to the housing, electrically connects the stator with a source of power. A connection device, mounted to the housing, forms a releasable electrical coupling between the stator cord and the stator.

In accordance with another aspect of the present invention, a method of electrically connecting a stator cord, located exterior to a housing, with a stator, located within the housing, is provided. The method includes threading a threaded portion of a connecting device into a threaded aperture formed in the housing to provide a seal which resists leakage of liquid from the housing. The method further includes releasably connecting an electrical connector on the stator cord with a socket of the connecting device. The connecting device includes an electrical connection path which provides electrical connection between the socket and the interior of the housing.

In accordance with another aspect of the present invention, a device for connecting a stator cord, exterior to a housing of an x-ray tube, to a stator motor, positioned within the housing, is provided. The device includes a threaded portion for threadable connection with an aperture in a wall of the x-ray tube housing and a connection portion for releasably coupling with a connection member on the stator cord. An electrical conduction path has first and second ends. The first end extends into the connection portion for forming an electrical connection with the stator cord connection member. The second end extends into the threaded portion for forming an electrical connection with an electrical wire of the stator.

One advantage of the present invention is that leakage through the stator wiring port is reduced.

Another advantage of the present invention is that it enables a wiring harness to be readily connected and disconnected to an x-ray tube.

Still further advantages of the present invention will become apparent to those of ordinary skill in the art upon reading and understanding the following detailed description of the preferred embodiment.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENT

Figure 1:
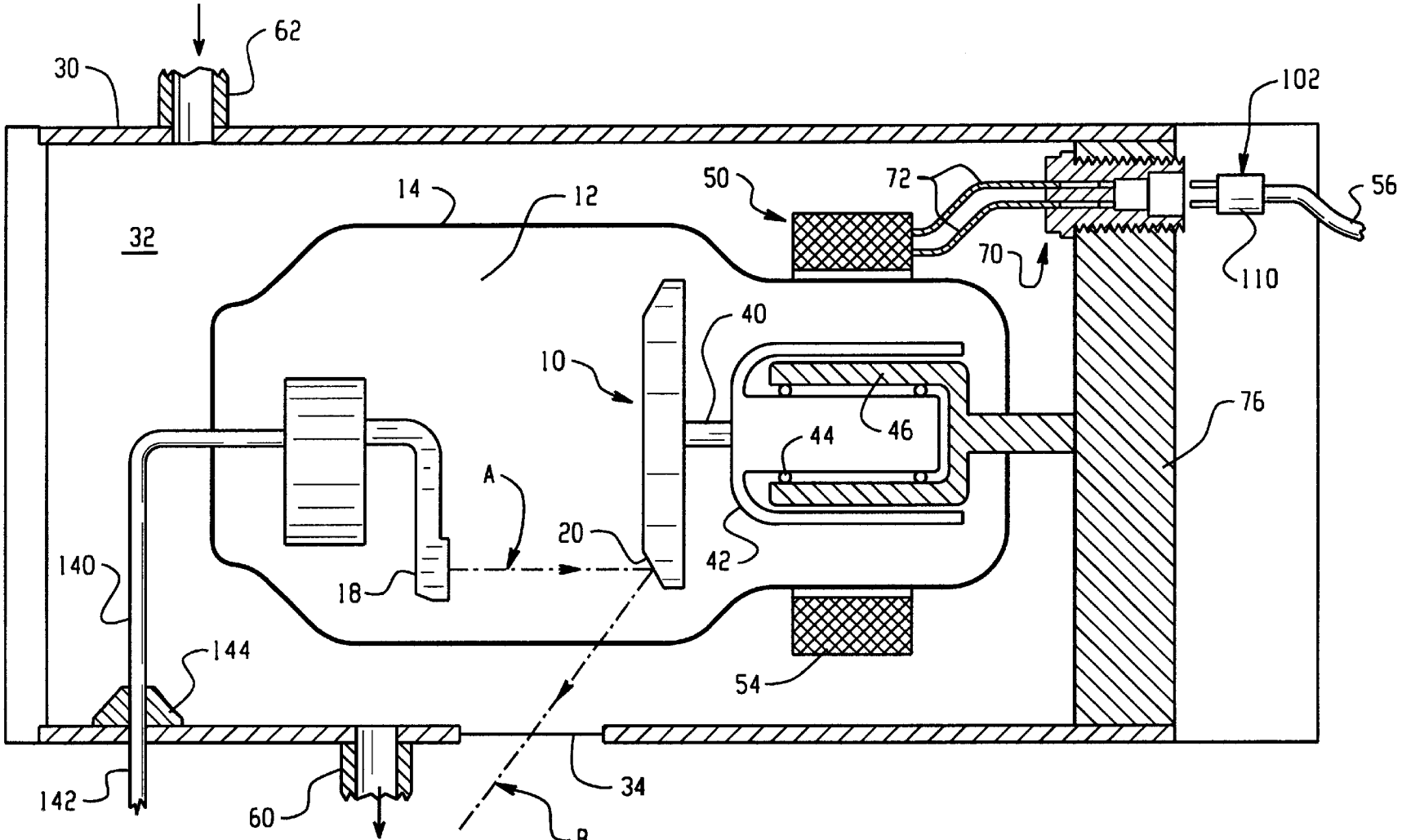
FIG. 1 is a schematic sectional view of a rotating anode tube in an oil filled housing according to the present invention.

With reference to FIG. 1, a rotating anode x-ray tube of the type used in medical diagnostic systems for providing a beam of x-ray radiation is shown. The tube includes a rotating anode 10 which is disposed in an evacuated chamber 12, defined typically by a glass envelope 14. A cathode assembly 18 supplies and focuses an electron beam A which strikes a target area 20 of the anode. A portion of the beam strikes the target area of the anode and is converted to x-rays B, which are emitted from the x-ray tube. The envelope is enclosed within a housing or cooling oil enclosure 30 filled with an oil 32. The x-rays pass through the cooling oil and an aluminum window 34 in the cooling oil enclosure or housing. It is this beam B of x-rays which serves the medical and diagnostic functions of the x-ray tube.

The anode is connected by a shaft 40 to a rotor or armature 42, such as a thin copper cylinder. The shaft is supported by bearings 44 for rotational movement within a stationary cylindrical 46 or sleeve portion of the rotor.

Figure 2:
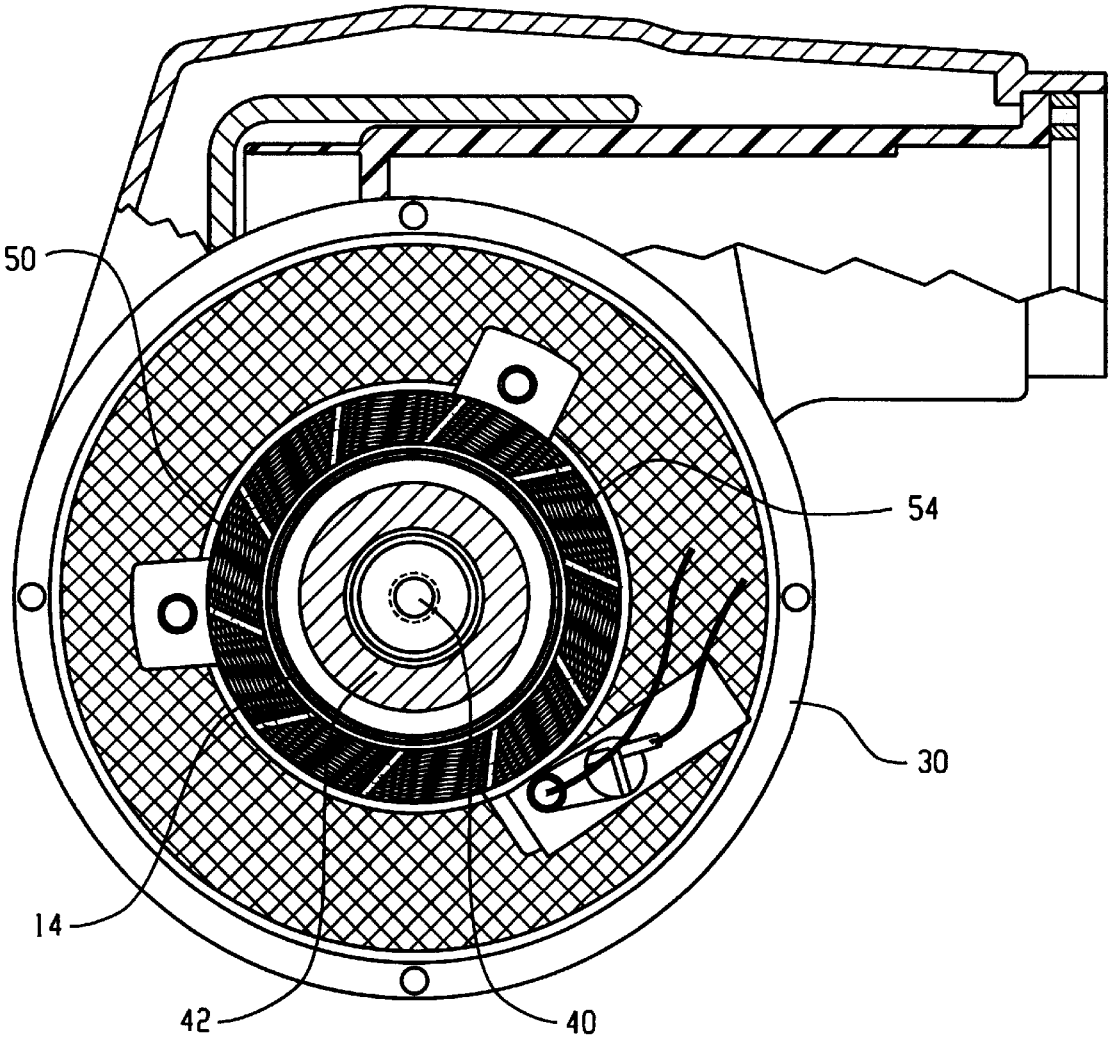
FIG. 2 is a schematic cross sectional view of a rotating anode tube of FIG. 1.
Figure 3:
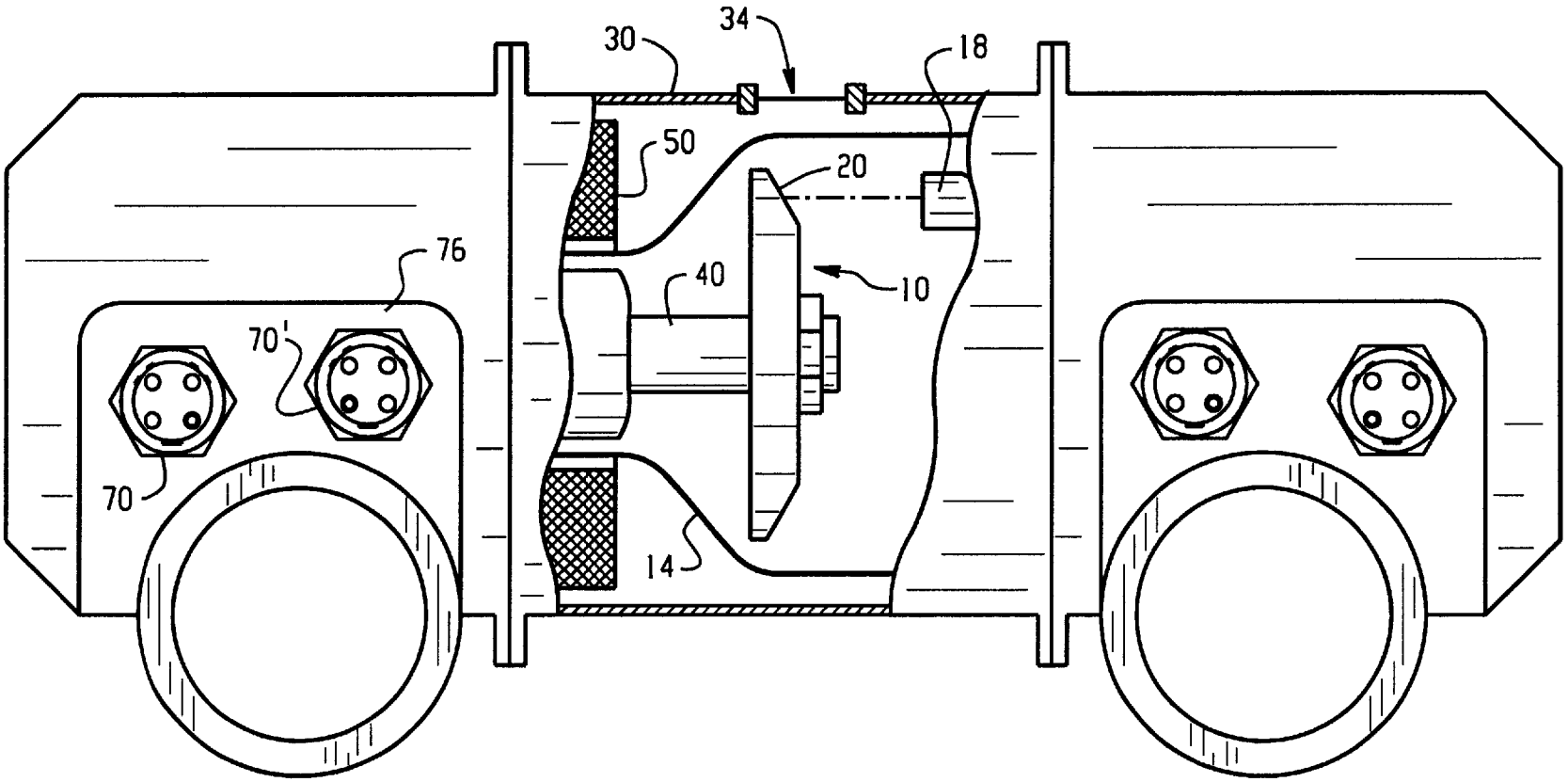
FIG. 3 is a side view in partial section of the rotating anode tube of FIG. 1.

With reference also to FIGS. 2 and 3, an annular stator 50 is contained within the housing 30 and surrounds the envelope 14 adjacent the rotor. When the stator is energized, driving coils 54 induce magnetic fields in the rotor 42, which cause the rotor and shaft to rotate relative to the stationary stator 50. Other types of motors are also contemplated. A stator cord 56 provides electrical connection between the stator 50 and a source of power (not shown).

The housing 30 is constructed to be oil tight for containing the insulating oil 32. A significant amount of heat is produced in the dielectric oil during generation of x-rays. The oil is circulated from the housing through an outlet port 60 to a heat exchanger (not shown) where the oil is cooled. The cooled oil is returned to the housing through an inlet port 62.

With reference also to FIGS. 4–7, a connection device 70 connects the stator cord 56 with wires 72 within the housing, which run through the oil chamber from the connection device to the stator 50. FIG. 3 shows two such connection devices 70, 70' connected with two sets of wiring, although it is to be appreciated that fewer or more connection devices may be employed.

Figure 4:
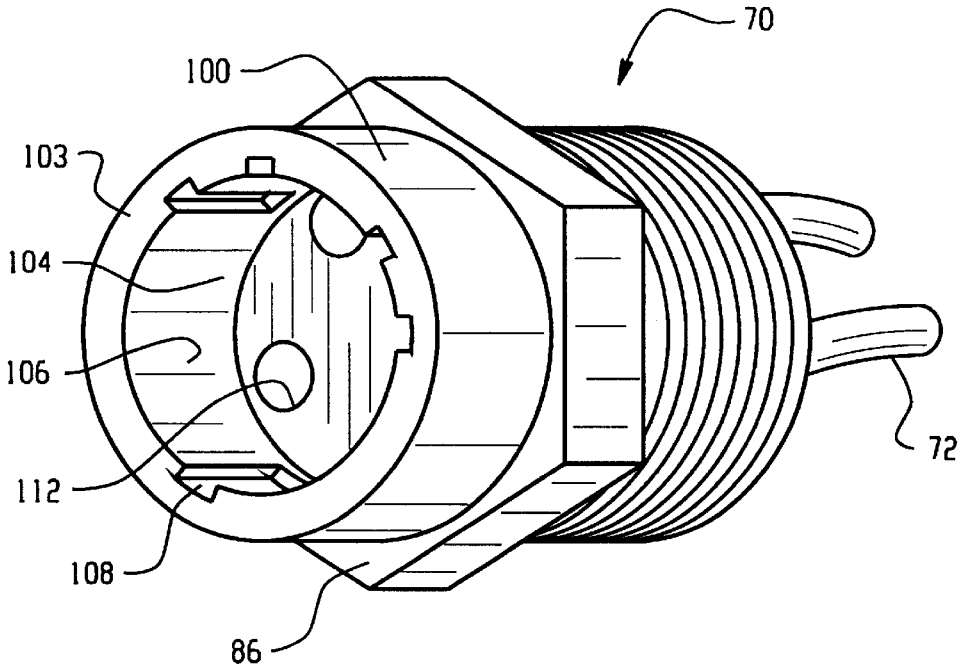
FIG. 4 is a greatly enlarged perspective view of the connecting device of FIGS. 1 and 3.
Figure 5:
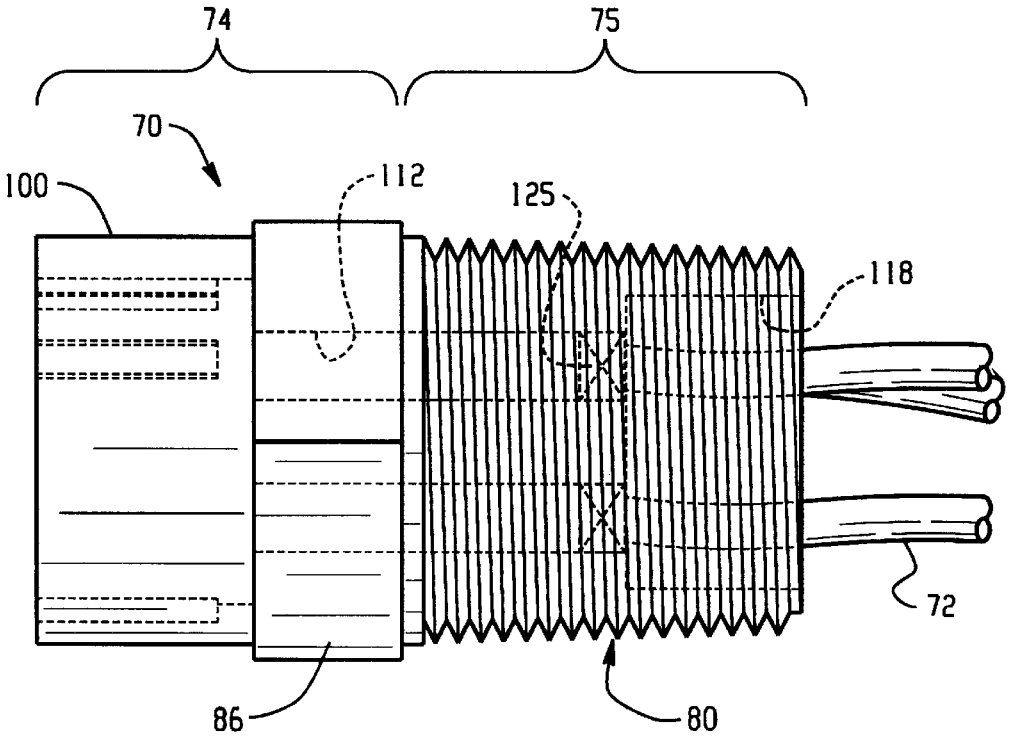
FIG. 5 is a side view of the connecting device of FIG. 4.
Figure 6:
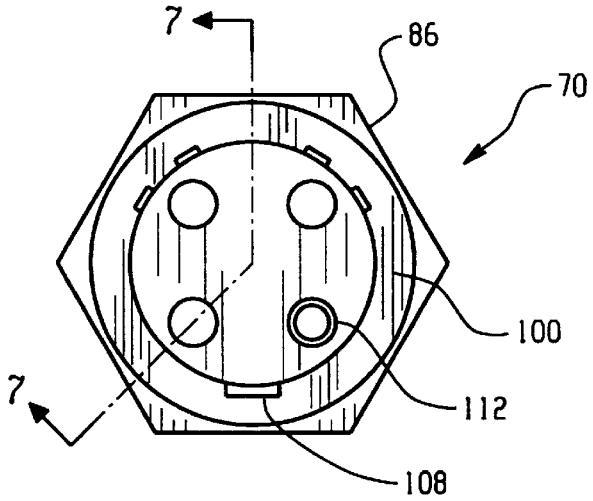
FIG. 6 is a top view of the connecting device of FIG. 4.
Figure 7:
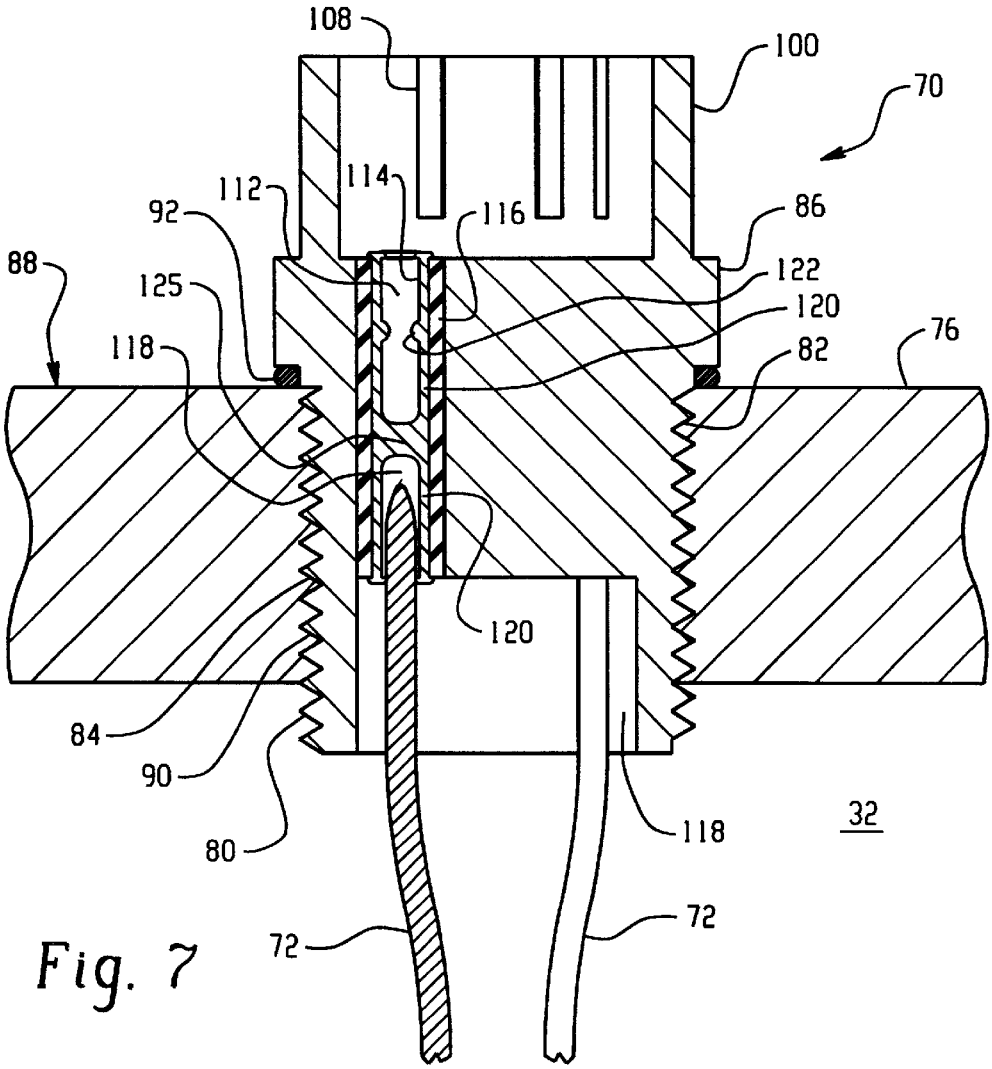
FIG. 7 is a side sectional view of the connecting device of FIG. 4, mounted into the wall of the x-ray tube housing.

The connection device 70 is generally cylindrical and has an exterior portion 74, which protrudes from the housing and an interior portion 75, which extends from the external portion into the housing. Specifically, the device is threadably mounted to a wall 76 of the housing, best shown in FIG. 7. The interior portion 75 of the connection device has a generally cylindrical threaded portion 80, such as an NPT thread, which is threaded into a tapped aperture 82 in the housing wall having corresponding internal threads 84. The exterior portion 74 includes a hexagonal flange portion 86 at its interior end, which is seated on an exterior surface 88 of the housing wall 76. The flange portion is preferably configured for receiving a suitable tool for rotation of the device during tightening or removing the connection device. FIGS. 4 and 6 show the flange portion as having the shape of a hexagonal nut.

Preferably, an epoxy or other adhesive material 90 is applied to the threaded portion 80 of the connector or the aperture prior to its threaded receipt into the aperture 82. The adhesive material is allowed to set, to seal the connection device to the housing wall 76 and improve the sealing connection of the device. Oil compatible epoxies are preferred adhesives. The epoxy may be heated prior to application to the threads. Additionally, the threaded portions may also be heated after threading to draw the adhesive into the joint.

Alternatively, or additionally, a gasket 92 such as an O-ring, received around the threaded portion, is positioned between the flange 86 and the housing wall.

The external portion 74 of the connection device 70 is configured for receiving a connecting member 102, such as a bayonet plug, positioned at the housing end of the stator cord 56. As best shown in FIG. 4, the external portion includes a bayonet type socket 100 comprising an annular wall 103 which defines a cavity 104. An interior surface 106 of the wall has slots or indents 108 to assure receipt of a body portion 110 of the connecting member in a preselected orientation. Bores 112 (four are shown in FIG. 6) extend from the base of the cavity into the threaded portion 80 of the connecting device. Each bore 112 holds a metal connector 114 surrounded by an insulating sleeve 116. The connector 114 has an interior sleeve 118 into which the wire 72 is soldered, crimped, mechanically fit, or the like. The connector also has a plug receiving sleeve 120 that has one or more portions 122 resiliently extending into the bore to engage the pins of the connector 102 in secure electrical contact. An electrical conduction path 125 is established by the connector 114 between the two sleeves, which also blocks the flow of cooling oil from the housing.

While the connection device has been shown with a bayonet fitting, other configurations for releasably coupling the connecting member 102 on the stator cord to the connecting device are also contemplated, such as internal threads.

The threaded portion 80, the flange portion 86, and the socket 100 of the connecting member may be integrally formed from a resilient material, such as stainless steel or high temperature plastic, for example, by machining, molding, or the like. Or, they may be separately formed and sealed together. For example, the threaded portion and the flange may be formed from stainless steel and the interior of the portion 80 from plastic or other dielectric material.

The internal wires 72 are electrically connected with the bores via the interior sleeve 118 in the threaded portion of the connecting device.

Figure 8:
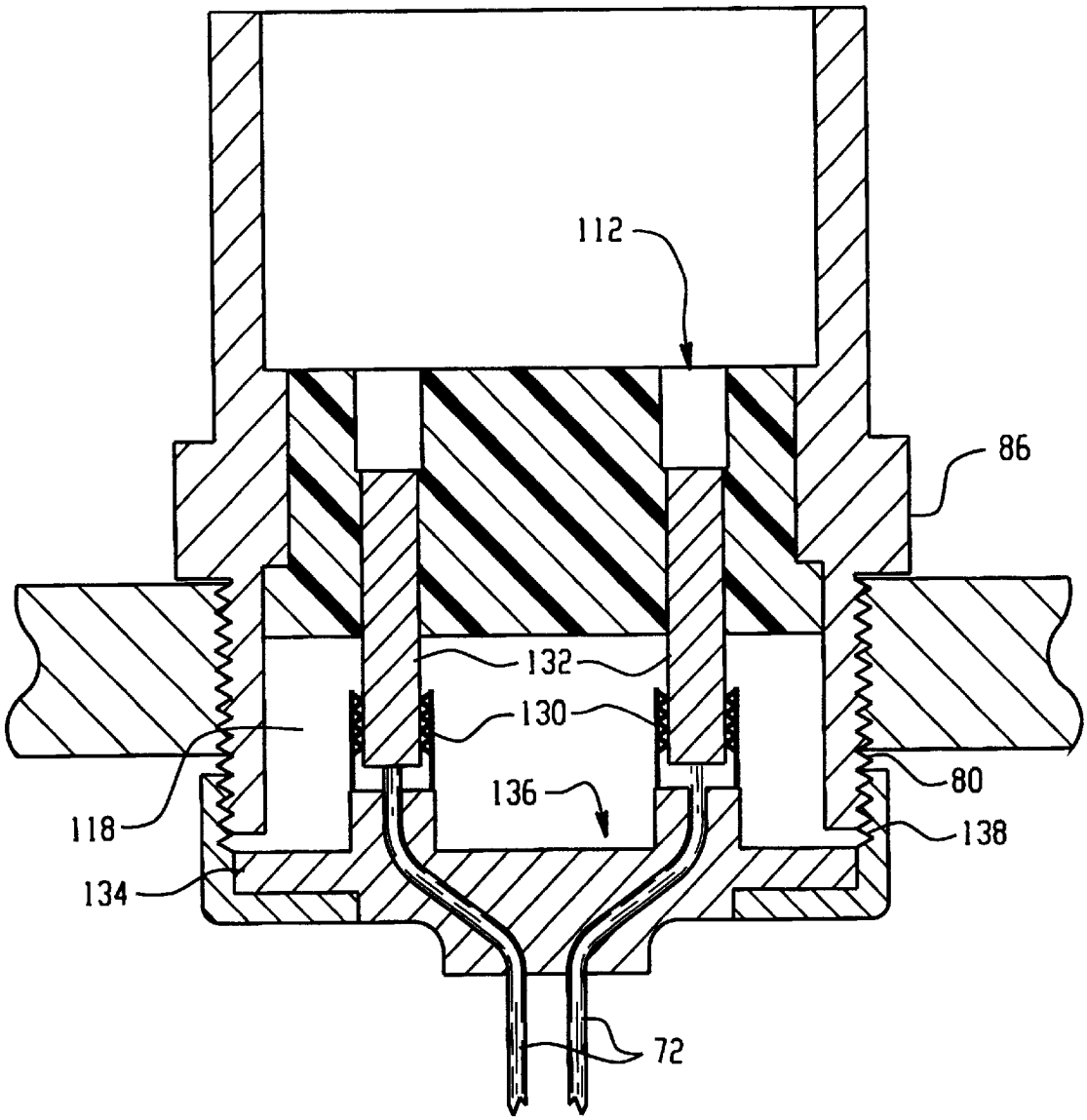
FIG. 8 is a side sectional view of an alternative embodiment of the connecting device of FIG. 1.

With reference now to FIG. 8, in one embodiment, the wires 72 are fitted with quick connects 130, which allow them to be releasably connected to corresponding quick connects in the internal cavity 118. The quick connects may take the form of spring loaded teeth, as shown in FIG. 8, which grip pins 132. The pins form the electrical pathway through the bores 112. The quick connects 130 are mounted in a socket 134 which seals a lower open end 136 of the cavity. As shown in FIG. 8, the socket has an internal threaded connection ring 138 which threads onto the external threads of the threaded portion 80 of the connection device to create a liquid tight or liquid resistant seal for the cavity 118. This inhibits cooling oil from entering the cavity 118, and provides an additional barrier to leakage of oil via the connection device.

To assemble the wiring for the x-ray tube, the exterior of the threaded portion 80 of the connection device is coated with adhesive and threaded into the housing aperture. At this point, the housing may be leak tested to ensure that a leak-tight connection has been made between the connection member and the housing wall. The internal stator wiring 72 is connected to the connection device 70 prior to filling the housing with oil. The x-ray tube can be packed, shipped, and transported around a facility without the cumbersome stator cord 56 attached.

When the x-ray tube is to be placed into service, the stator cord connector 102 is plugged into the bayonet fitting. The stator cord can be readily removed, when necessary, for replacement of the wiring or for transporting the x-ray tube to a repair site.

While the invention has been described with reference to a device 70 for connecting a stator cord to an x-ray tube, it should be appreciated that the device may be used for connecting other electrical wiring in the x-ray tube. For example, wiring 140 for the cathode assembly 18 may be connected to external wiring 142 by a similar connection device 144, as may the high voltage connections.

The invention has been described with reference to the preferred embodiments. Obviously, modifications and alterations will occur to others upon reading and understanding the preceding detailed description. It is intended that the invention be construed as including all such modifications and alterations in so far as they come within the scope of the appended claims or the equivalents thereof.

Having thus described the preferred embodiment, the invention is now claimed to be:

1. An x-ray apparatus comprising:

a housing which defines a threaded aperture;

an evacuated envelope contained within the housing, the evacuated envelope containing a rotatable anode which is biased to a high positive potential and a cathode that is biased to a high negative potential;

a stator within the housing, which generates a magnetic field for rotating the anode within the envelope;

cooling oil disposed in the housing surrounding the evacuated envelope;

an electrical socket separate from high positive and negative potential feedthroughs, mounted to the housing, forming an electrical coupling, the socket including:

a threaded peripheral portion which is threadably connected with the threaded aperture in the housing;

at least one electrically conductive member separated from the threaded peripheral portion by cooling oil impermeable insulation;

a connection portion for releasably coupling with a corresponding connection member;

an electrical conduction path connected at one end to the stator and at the other end to the electrically conductive member within the housing;

an external stator cord which has the corresponding connection member mounted on one end thereof, the corresponding connection member having a electrical connector which releasably connects to the socket conductive member.

2. The apparatus of claim 1, wherein the connection member includes a bayonet connector.

3. The apparatus of claim 1, further including:

a plurality of electrical conductive members electrically isolated from each other in the cooling oil impermeable insulation.

4. A method of electrically connecting a stator cord, located exterior to a housing of an x-ray tube, with a stator, located within the housing, the housing containing a cooling liquid, the method comprising:

threading a threaded portion of a connecting device into a threaded aperture formed in the housing to provide a seal which resists leakage of the liquid from the housing;

after the step of threading, electrically connecting the stator with the connection device; and releasably connecting an electrical connector on the stator cord with a socket of the connecting device, the connecting device including an electrical connection path which provides electrical connection between the socket and the interior of the housing.

5. The method of claim 4, wherein the method further includes:

forming an electrical connection between the stator and the electrical path, including:

connecting at least one wire within the housing with the electrical path.

6. The method of claim 5, wherein the step of connecting the wire within the housing with the electrical path includes:

releasably coupling the wire with the electrical path.

7. The method of claim 4, wherein the step of connecting an electrical connector on the stator cord with a socket of the connecting device includes releasably coupling a bayonet plug with a bayonet socket.

8. The method of claim 4, wherein the connecting device has a plurality of electrical connection paths which are insulated from each other and the socket and further including:

connecting a plurality of leads from the stator with the electrical connection paths.

9. The method of claim 4, further including:

prior to the threading step, applying an elevated temperature adhesive/sealant to the threaded portion.

10. A method of electrically connecting a stator cord, located exterior to a housing, with a stator of a rotating anode x-ray tube, located within the housing, the method comprising:

applying an elevated temperature adhesive/sealant to a threaded peripheral portion of an electrical connecting device;

threading the threaded peripheral portion of the electrical connecting device into a threaded aperture in the housing;

after the threading step, heat curing the adhesive/sealant to provide a seal which resists leakage of cooling oil from the housing;

electrically connecting the electrical connecting device to driving coils of the stator;

filling the housing with cooling oil; and releasably connecting an electrical connector on the stator cord for supplying power to the stator driving coils with the electrical connecting device.

* * * * *